US005272274A

United States Patent [19]

Kimura

[11] Patent Number: 5,272,274

[45] Date of Patent: Dec. 21, 1993

[54] ELECTRONIC MUSICAL INSTRUMENT WITH REVERBERATION EFFECT

[75] Inventor: Hidemichi Kimura, Hamamatsu, Japan

[73] Assignee: Yamaha Corporation, Hamamatsu, Japan

[21] Appl. No.: 880,285

[22] Filed: May 4, 1992

Related U.S. Application Data

[63] Continuation of Ser. No. 562,312, Aug. 3, 1990, abandoned.

[30] Foreign Application Priority Data

Aug. 10, 1989 [JP] Japan ..... 1-95119[U]

[51] Int. Cl.[5] ..... G10H 1/02; G10H 1/057; G10H 1/18

[52] U.S. Cl. ..... 84/658; 84/662; 84/663; 84/DIG. 26; 381/63

[58] Field of Search ..... 84/615, 622-633, 84/658, 662-665, 687-690, 701-711, DIG. 26; 381/63

[56] References Cited

U.S. PATENT DOCUMENTS 4,586,417 5/1986 Kato et al. ..... 84/630
4,909,119 3/1990 Morokuma .
4,909,121 5/1990 Usa et al. ..... 84/606

FOREIGN PATENT DOCUMENTS 64-59391 3/1989 Japan .
1-101590 4/1989 Japan .
1-198797 8/1989 Japan .
2-110500 4/1990 Japan .

*Primary Examiner*—Stanley J. Witkowski
*Attorney, Agent, or Firm*—Graham & James

[57] ABSTRACT

An electronic musical instrument is provided with a touch data generating device and a reverberation unit which generates a reverberation signal. The reverberation unit generates the signal correspond to the musical tone signal based on the touch data. The reverberation unit has a reverberation parameter forming device for forming a reverberation parameter which controls the reverberation signal based on the touch data. The parameter includes a delay period for a delay element and/or a coefficient for a multiplier. The musical instrument is allowed to add a mixing device to it, for mixing the musical tone signal and the reverberation signal. The musical instrument is also allowed to have a channel detecting device for detecting the number of instructed channels in place of the touch data generating device, thereby the reverberation signal being controlled by the number of the instructed channels.

19 Claims, 13 Drawing Sheets

A: ATTACK RATE
D: DECAY RATE
R: RELEASE RATE
S: SUSTAIN LEVEL

ELECTRONIC MUSICAL INSTRUMENT WITH REVERBERATION EFFECT

This is a continuation of copending application Ser. No. 07/562,312 filed on Aug. 3, 1990, and now abandoned.

BACKGROUND OF THE INVENTION

1. Field of the Invention

This invention relates to a controlling of reverberation of electronic musical instrument.

2. Description of the Prior Art

Usual electronic musical instruments adopt a sensor to control a musical tone, especially tone color waveform. For example, attack waveform of an envelope (displacement curve of a tone volume level) is controlled according to initial touch intensity (to be detected based on key pressing speed), and vibrato (a periodic minute fluctuation of a tone volume and a pitch) is controlled according to aftertouch intensity (to be detected based on pressure after key pressing).

One of important coefficients which affect an impression of the musical tone is a reverberation (sound) of the musical tone. Until now, the reverberation was controlled by the effect unit connected to a musical tone generation unit.

Consequently, all the musical tones remain uniformly during reverberation time, making it impossible to give different reverberation effect to each musical tone. Therefore, unlike acoustic pianos, it was impossible to express the difference in reverberation time (period) based on the pertinent musical tone keying intensity. Also, because various reverberation controls by key operations were impossible, expression was poor.

SUMMARY OF THE INVENTION

It is therefore an object of the present invention to provide an electronic musical instrument in which the above-mentioned problem has been solved by controlling the reverberation based on key touch intensity.

In the electronic musical instrument of this invention reverberation of musical tone is controlled based on key touch intensity (initial touch intensity,, aftertouch intensity or release touch intensity). Generally, the reverberation is intensified more or the reverberation time is increased as the touch intensity increases .

So as to realize this control, a reverberation parameter is generated based on a touch data of an operated key, and a reverberation signal is generated based on the reverberation parameter. For example, the more the touch intensity increases, the more a reverberation level increases so that the reverberation is increased. Moreover, it is possible to prolong the reverberation time, as the touch intensity is increased, by adjusting the reverberation time based on the touch intensity.

In this invention, the reverberation signal is also controlled by the number of musical tone signals (the number of tone generating channels) as a key is operated. This makes it possible to express the variation of spread of tone depending on the touch intensity or the number of tone generating channels. Furthermore, it is possible to reproduce sound of acoustic pianos.

BRIEF DESCRIPTION OF THE DRAWINGS

FIGS. 8(A) to 8 (C) are flowcharts showing the operations of control section.

DESCRIPTION OF THE PREFERRED EMBODIMENT

Figure 1:
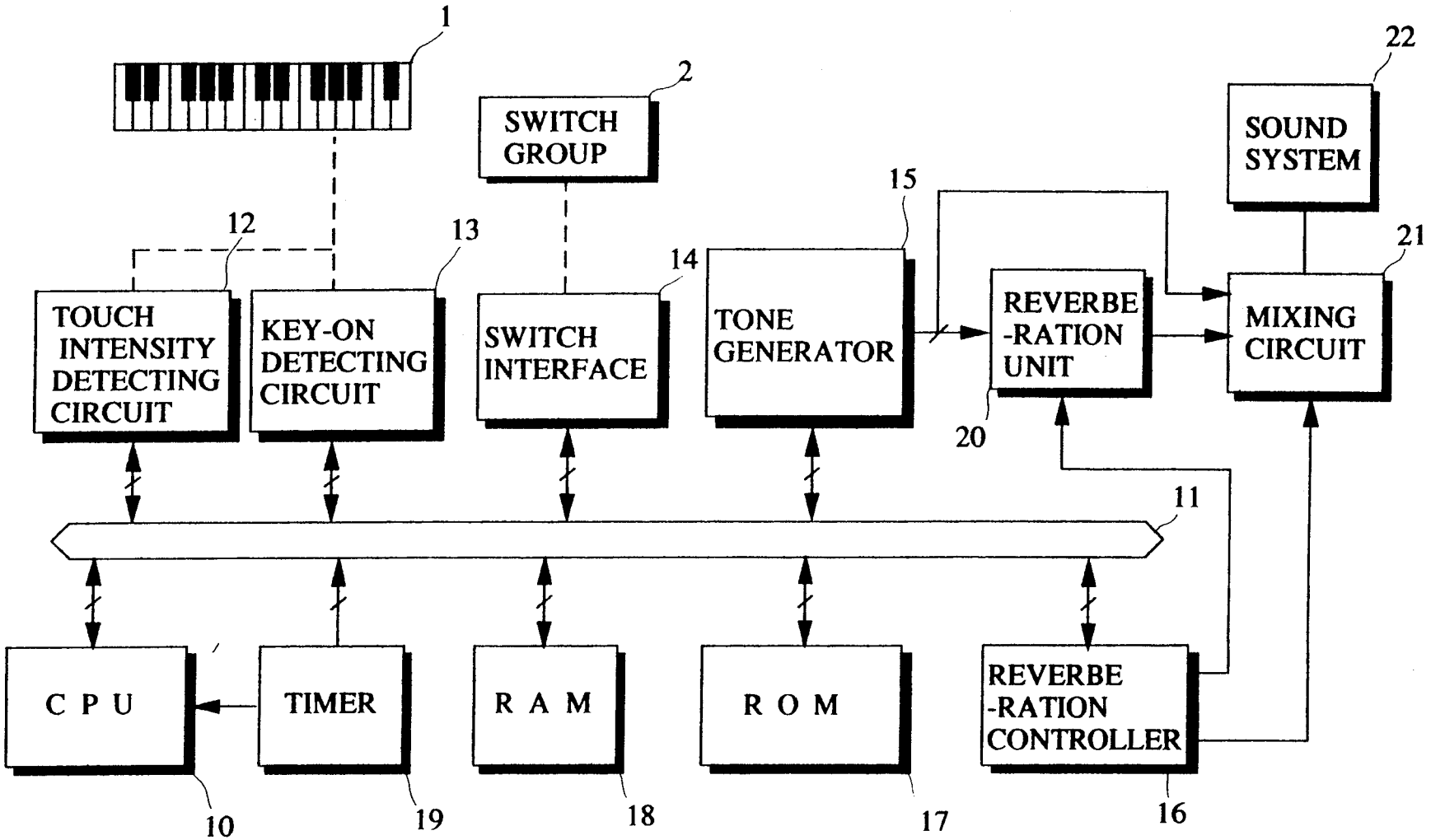
FIG. 1 is a block diagram of a control section of an electronic keyboard musical instrument which is an embodiment of this invention.

FIG. 1 is a block diagram showing an electronic keyboard musical instrument which is an embodiment of this invention. A keyboard 1 covers a compass of 4 to 5 octaves. A tone generator 15 has 8 channels, each of which can generate tone individually. The tone generator 15 generates a musical tone signal of the pressed key. A switch group 2, including tone color selection switch, and a sound system 22 are provided on the external part of the musical instrument in addition to the keyboard 1. Operations of the musical instrument are controlled by a CPU 10. The memory and each operating section are connected to the CPU 10 through a bus 11. A touch intensity detecting circuit 12, a key on detecting circuit 13, a switch interface 14, the tone generator 15, a reverberation controller 16, a ROM 17, a RAM 18 and a timer 19 are connected to the bus 11. The key-on detecting circuit 13 and the touch intensity detecting circuit 12 detect respectively, ON/OFF of key of the keyboard 1 and key touch intensity (initial touch intensity or aftertouch intensity). The switch interface 14 detects ON/OFF of each switch of the switch group 2. The tone generator 15 has 8 independent channels capable of generating tone. It can generate simultaneously up to 8 tones based on the waveform signal sent from the CPU 10. The musical tone signal generated by the tone generator 15 is inputted into a reverberation unit 20 and a mixing circuit 21. An output signal of the reverberation unit 20 is inputted into the mixing circuit 21. An output signal of mixing circuit 21 is inputted into the sound system 22 consisting of an amplifier, a speaker, etc., so that the musical tone is generated. The reverberation unit 20 is a circuit to generate the reverberation signal of the inputted musical tone signal.

Figure 2A:
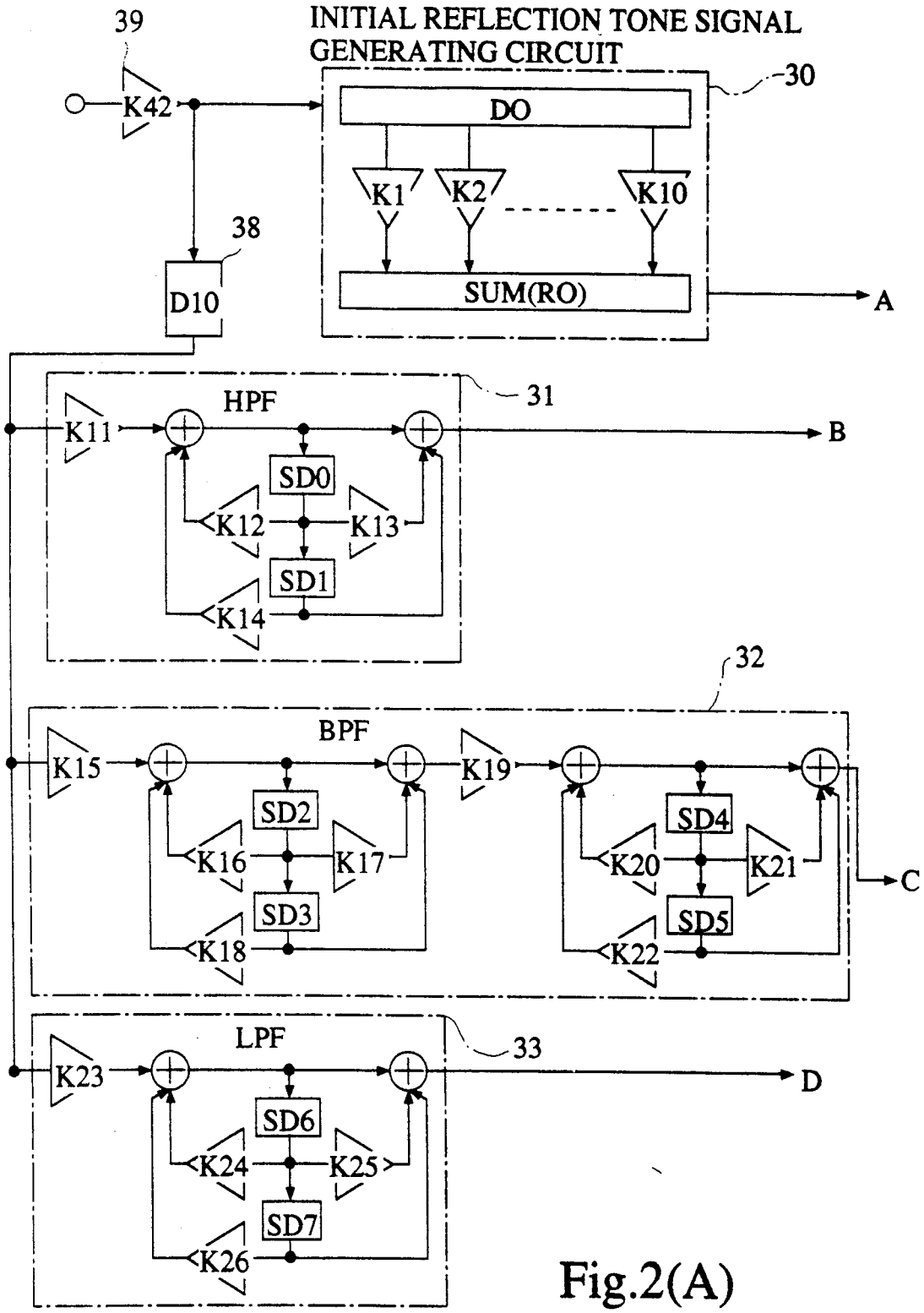
FIGS. 2(A) and 2(B) are block diagrams of an example of a reverberation unit.
Figure 2B:
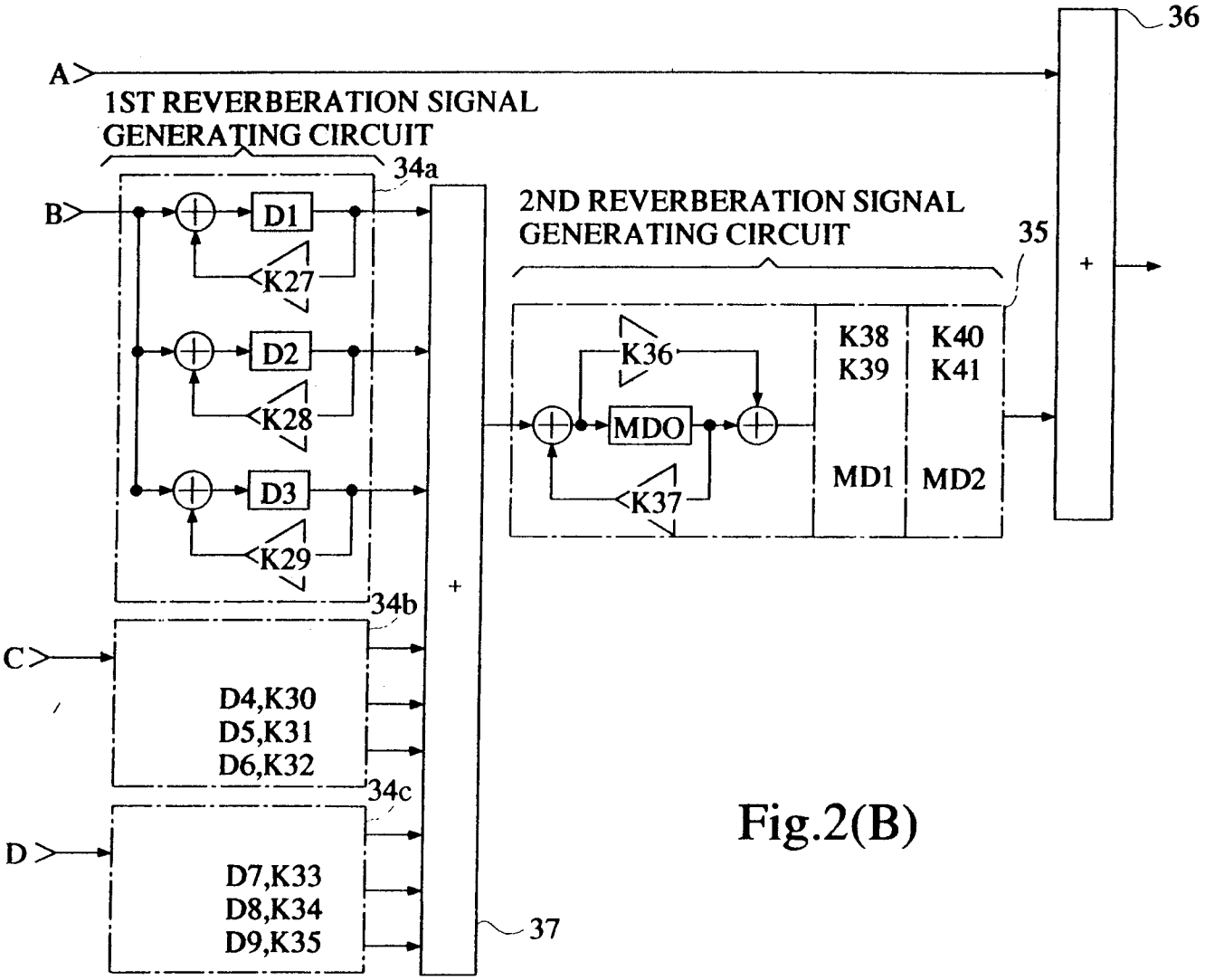

FIG. 2 shows a block diagram of an example of the reverberation unit 20. This reverberation unit 20 comprises an initial reflection tone signal generating circuit 30, a high pass filter 31, a band pass filter 32, a low pass filter 33, a first reverberation signal generating circuit 34 which consists of three parts 34*a*, 34*b* and 34*c*, a second reverberation signal generating circuit 35 and an adder 36. This unit 20 has also a multiplier element 37 and a delay element 38.

The initial reflection tone signal generating circuit 30 generates an initial reflection tone signal of an input signal. It comprises a shift register as delay element, having coefficient D0 which decides the number of stages of itself, ten multipliers having coefficient K, and an adder SUM which includes a register R0 to memory the adding result of the adder SUM. The musical tone signal data which is sampled with specific period is supplied to the shift register successively. Each output data of the shift register's stages inputs to the multipliers respectively, the output data being multiplied by the coefficient K. For example, the first stage output data which is most latest input data is multiplied by the coefficient K1 whereas the tenth stage output data which is most oldest data is multiplied by the coefficient K10. The adder SUM adds the output signals of the multipliers. The register R0 in the adder SUM memories the adding result of the adder SUM temporarily.

The high pass filter 31, the band pass filter 32, and the low pass filter 33 perform filtering, respectively, of an output data of the delay element 38. Each filter has some multipliers, adders, and delay elements. The multiplier located at input part of each filter decides a input level to the filter, therefore the coefficient K11, K15 or K23 can vary frequency characteristic of the reverberation tone. The first reverberation signal generating part 34*a* receives the output signal of the high pass filter 31, the second reverberation signal generating part 34*b* receives the output signal of the band pass filter 32, and the third reverberation signal generating part receives the output signal of the low pass filter 33. In this embodiment of this invention, each part is provided with three delay elements having different delay time intervals one another, three multipliers, and three adders. Three in a set elements comprising one multiplier, one delay element, and one adder make one reverberator and three reverberators are connected parallel in each reverberation signal generating part. In the above reverberator, the delay time interval of the delay element simulates the time interval with which a sound travels from one wall to another wall in a music hall. The coefficient of the multiplier, for example, is a coefficient for simulating a reflection rate of the walls. Therefore, the reverberation time can be varied by the coefficient. The output signal of the first reverberation signal generating circuit 34 is added each other with the adder 37. This first reverberation signal generating part 34 can generate main reverberation signals. The adder 37's output signal is inputted into the second reverberation signal generating circuit 35. This circuit 35 is equipped with three reverberators connected in series, each of which forms an all pass filter. It simulates phase disorder which happens at a moment of the reflection. The delay time interval of the reverberator is shorter than that of the reverberator in the first reverberation signal generating circuit 34. The adder 36 adds the output signal of the initial reflection tone signal generating circuit 30 to the output signal of the second reverberation signal generating circuit 35.

The multiplier 39 which is located at the input part controls input level to the reverberation unit 20. That is, the reverberation tone volume can be controlled with the coefficient K42. Each multiplier of the filters 31 to 33 controls input level to each filter, therefore whole frequency characteristic of the reverberation tone can be controlled with the coefficients K11, K15, and K23. And the reverberation time can be controlled with the coefficients K27 to K41.

Figure 3:
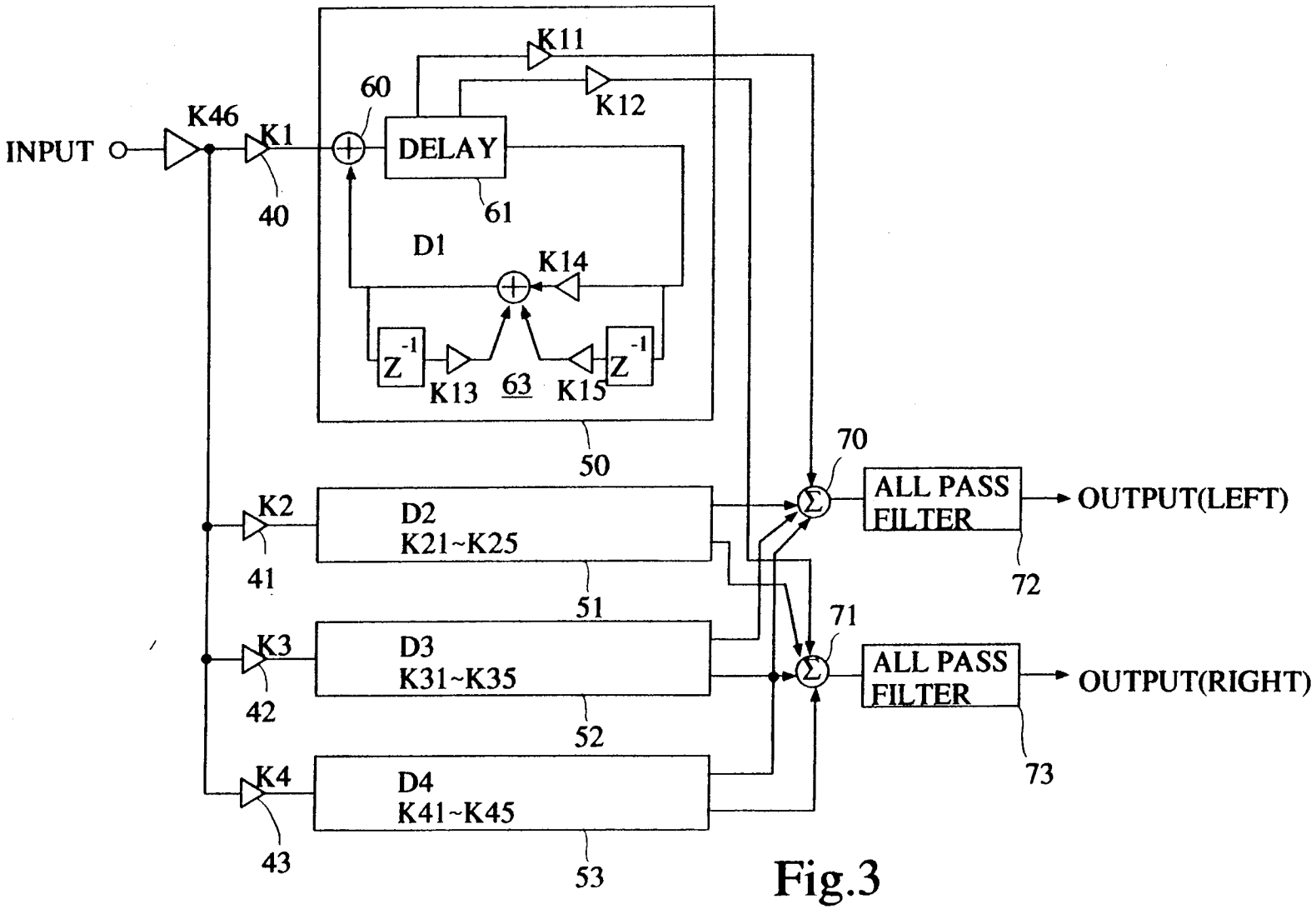
FIG. 3 and FIG. 4 are block diagrams of an another example of the reverberation unit.

FIG. 3 shows a block diagram of an another example of the reverberation unit 20.

This unit is provided with multipliers 40 to 43, closed loop circuits (feed back loops) 50 to 53, adders 60 and 61, and all pass filters 72 and 73.

The closed circuits 50 to 53 are similar to the reverberation signal generating circuit 34 (FIG. 2) in main part which includes a delay element for the input signal, a multiplier for multiplying the delayed signal by the coefficient, and a feedback circuit for the multiplied signal.

The delay element 61 is composed of a shift register having two output stages each of which outputs a different delay signal than the other. The outputs of the stages are inputted to the adder 70 and 71 through the multipliers respectively. The circuit 63 in the feedback loop forms a low pass filter; the musical tone signal circulated in the feedback loop decays in high frequency band sooner than in low frequency band. The player's suitable reverberation state of reverberation time (period) and the frequency characteristics of the reverberation can be set by proper selection of the coefficients K13 to K15. The feedback loops 50 to 53 being different in delay time each other and the parallel connection of the feedback loops allow to make the reverberation tone complex and high density.

Each two output signals from the feedback loops 50 to 53 are inputted to the adders 70 and 71 respectively, and the added signals are outputted through the all pass filter 72 and 73 as a LEFT OUT SIGNAL and a RIGHT OUT SIGNAL respectively. The all pass filters 72 and 73 are used to simulate the phase distortion of the reflection timing as well as the all pass filter 35 in FIG. 2.

In this example, the LEFT OUT SIGNAL differs from the RIGHT OUT SIGNAL in the delay time (due to the number of stages of the delay element 61). This makes a different reverberation tone in the LEFT and the RIGHT so that it gives a stereo effect of the reverberation tone.

According to this example, the reverberation tone volume can be controlled by applying of the coefficient K46, the reverberation time and the frequency characteristics can be controlled by applying of the coefficients K13 to K55, and the reverberation density is controlled by applying of ON/OFF of the coefficients K40 to K43. The coefficients K11 and K12 are used to control a balance between Left and right tone.

Figure 4:
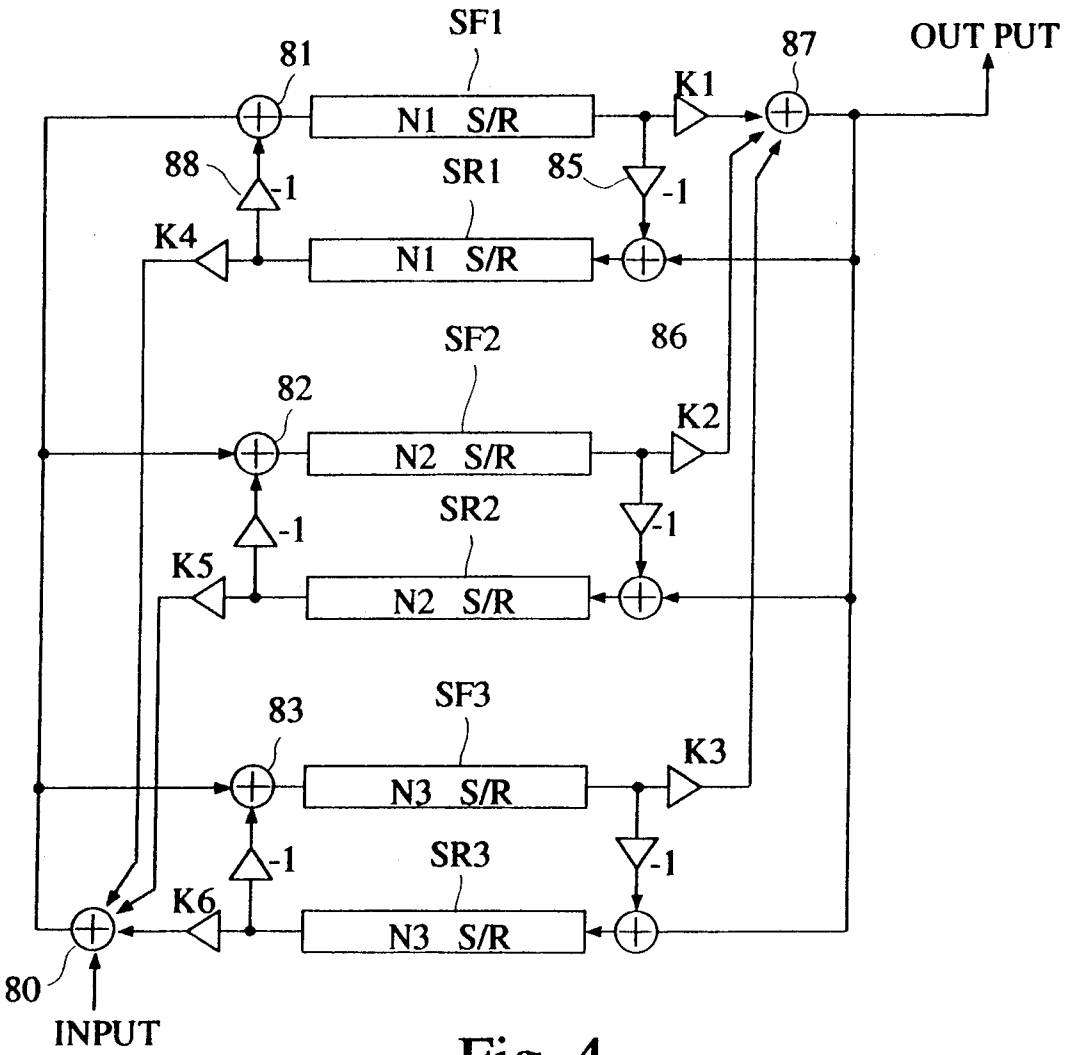

FIG. 4 shows a block diagram of an another example of the reverberation unit 20.

This unit is provided with six shift registers SF1 to SF3 and SR1 to SR3 as delay elements, and some adders and multipliers.

The shift registers SF1 to SF3 and SR1 to SR3 are used to delay signals with variable delay time. The shift registers SF differs from the shift registers SR only in the fact that the delay time of the shift registers SF is little longer than that of the shift registers SR. A feedback loop forming the reverberation signal is composed of the adder 81, the shift register SF1, the inverter 85, the adder 86, the shift register SR1, and the inverter 86. This unit features that several feedback loops connected with network which can simulates very much complex reflection and scattering. The reason for the relative little delay time of the shift register SR lies in that it has a function like the filter 63 in FIG. 3. It is available that the shift register SR is set to longer delay time.

In this example, the reverberation time (period), the reverberation tone volume, the frequency characteristics, and the reverberation density are controlled by the coefficients K1 to K3 and K4 to K6 and the number of the stages of each shift register.

Figure 5:
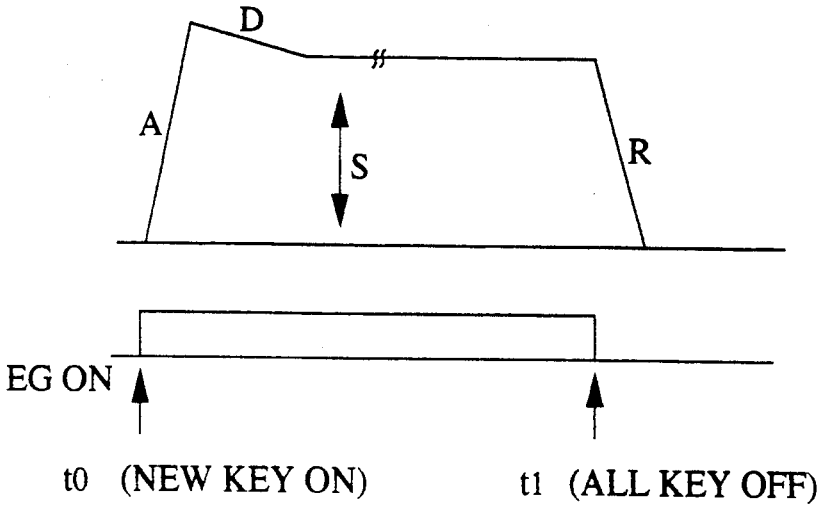
FIG. 5 shows envelope wave generated by a envelope generator.

The reverberation unit 20 above shown superposes the reverberation signal generated by itself on the musical tone signal and outputs thus obtained signal. The mixing circuit 21 mixes the signals outputted from the tone generator 15 and the reverberation unit 20 with a proper ratio and outputs the mixed signal to the sound system 22. The reverberation parameters including the coefficient K and D (K indicates multiplying coefficient at each multiplier and D indicates delay time of each delay circuit or stage number of each shift register.) set in the reverberation unit 20, and the mixing parameters supplied to the mixing circuit 21 are formed by the reverberation controller 16. In this example the reverberation controller 16 forms envelope parameters (envelope control coefficients) as the mixing parameters for the reverberation signal. FIG. 5 shows an example of typical envelope wave of the reverberation signal. The envelope parameters include "A" for setting attack rate, "D" for decay rate, "R" for release rate, "S" for sustain level and "EGLVL" for whole wave level. An EG (Envelope Generator) in the Mixing circuit 21 is turned on when it receives EGON signal from the reverberation controller 16. The reverberation controller 16 sets up the EG ON signal when a new key turned on, whereas reset the signal when all keys turned off.

Figure 6:
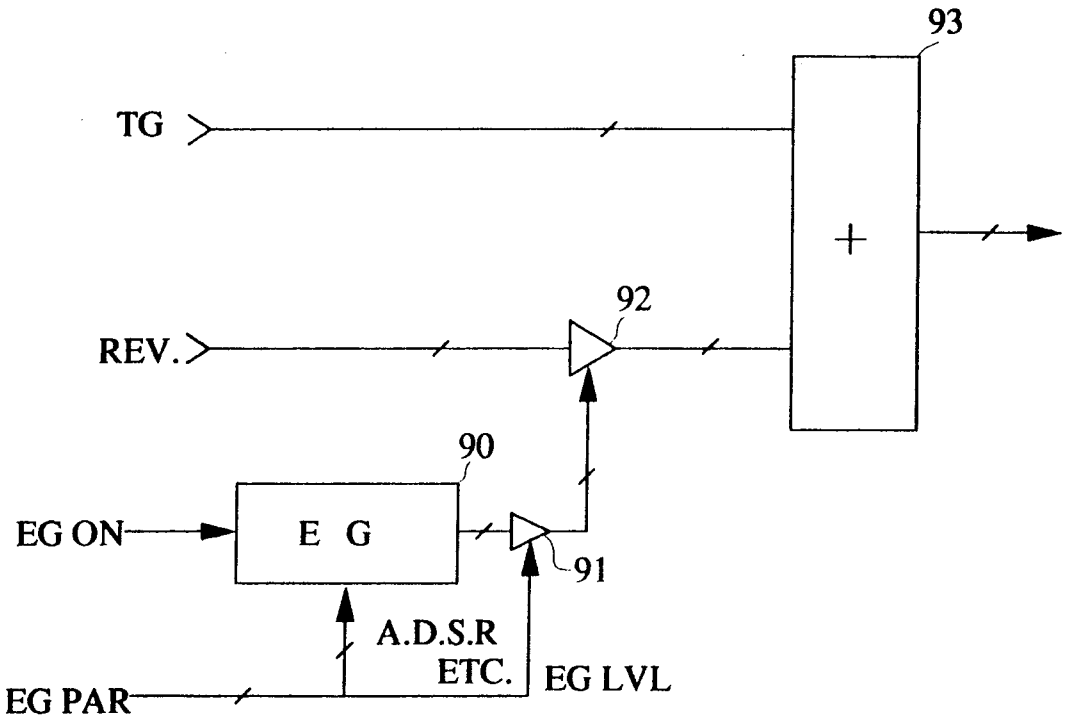
FIG. 6 is a block diagram of an example of a mixing circuit.

FIG. 6 shows an example of the mixing circuit 21. This circuit 21 comprises an EG 90 which generates a signal for envelope control of the reverberation signal based on the EGPAR (envelope parameters) supplied from the reverberation controller 16, a multiplier 91 which multiplies the output signal of the EG 90 by the EGLVL to decide envelope level, a multiplier 92 which multiplies the reverberation signal by the output signal of the multiplier 91, and an adder 93 to add the output signal of the multiplier 92 to the musical tone signal outputted from the tone generator 15. The EG 90 outputs the signal for envelope control to the multiplier 91 based on the envelope parameters ("A", "D", "R", and "S"), when it receives EGON signal from the reverberation controller 16. The multiplier 91 multiplies EG's output signal by the EGLVL, and outputs the obtained signal to the multiplier 92. The output signal of the multiplier 91 decides mixing rate of the adder 93.

Figure 7:
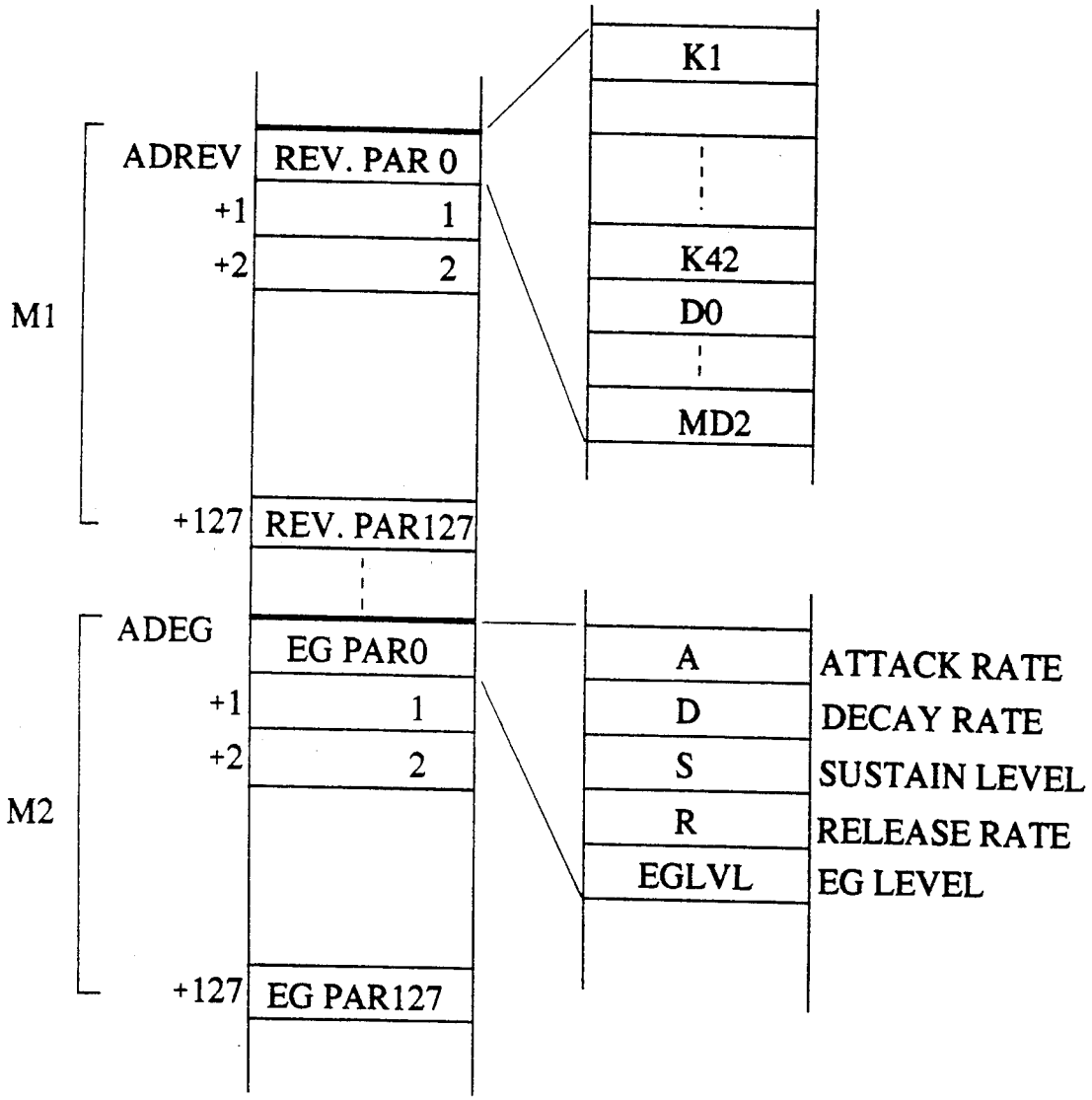
FIG. 7 shows a parameter table.

FIG. 7 shows a parameter table in the RAM 18. This table comprises two areas M1 and M2. The M1 area memories parameters for the reverberation unit 20 shown in FIG. 2. For example, K(n) is the coefficient (parameter) for the multiplier and D(n) is the coefficient for the delay element. Start address of the M1 area is named ADREV. The M1 area has 128 cells, each of which has n byte areas to memory the coefficients K1 to MD2. While the M2 area memories envelope parameters shown in FIG. 5. Start address of the M2 area is named ADEG. The M2 area has also 128 cells, each of which has five byte areas to memory the envelope parameters "A", "D", "S", "R" and "EGLVL". This table means that the max level (step number) of the initial touch intensity detected by the touch intensity detecting circuit 12 is 127 whereas the minimum level (step number) is 0. Namely when initial touch intensity level is detected as TOUCH, the address M containing coefficients for reverberation unit 20 is found as follows.

$$M=(\text{ADREV}+\text{TOUCH}^{*}\ n(\text{byte}))$$

The address M' for the mixing circuit 21 is found in the same manner. The founded coefficients are sent to the reverberation unit 20 and the mixing circuit 21 respectively.

In place of above mentioned manner, it is possible that each parameter is decided based on a function of TOUCH, for example, $$A=a\ \text{TOUCH}+b$$

where A is the parameter and a and b are optional constants.

In this example, owing to EG control of reverberation signal more complex control of mixing is possible.

Figure 8:
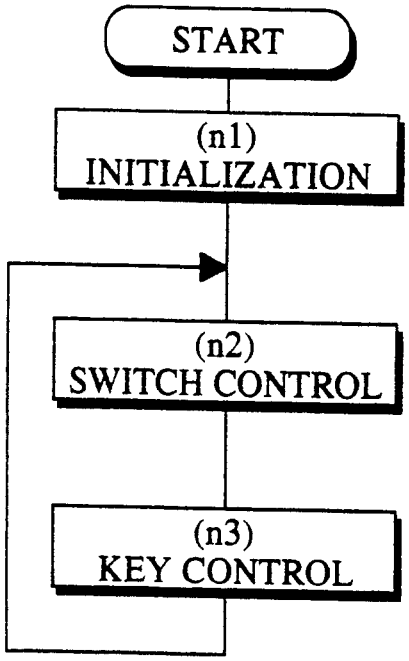
Figure 8:
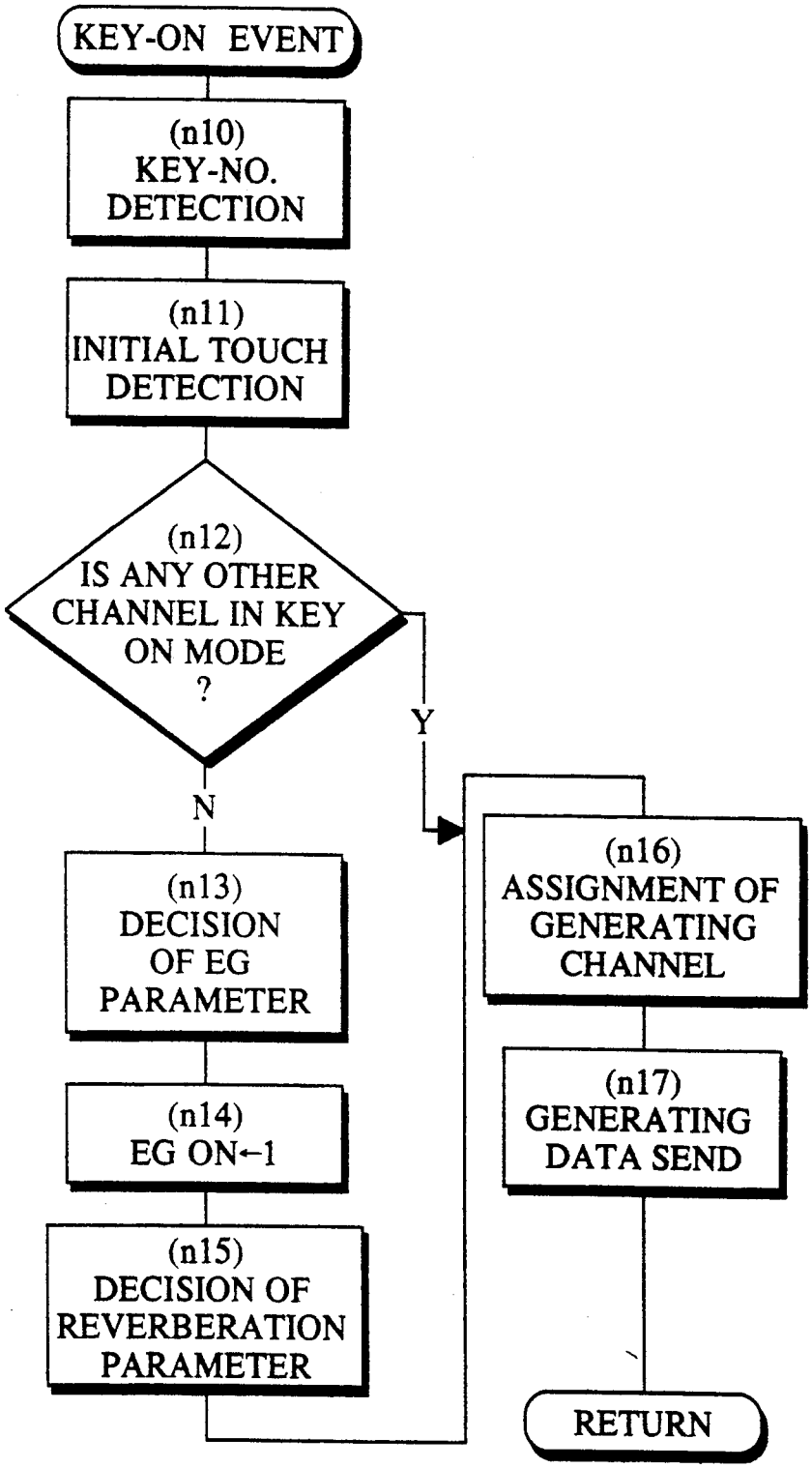
Figure 8:
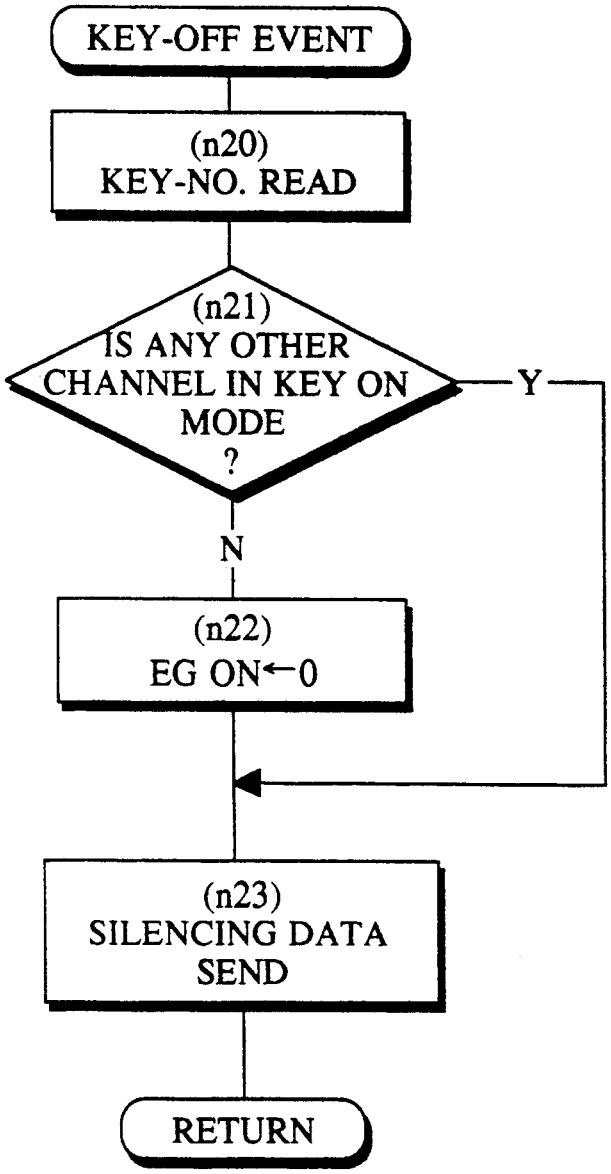

FIGS. 8 (A) to 8 (C) are flowcharts showing the operation of the electronic keyboard musical instrument.

FIG. 8 (A) shows a main routine. If the power supply is turned on, initialization is performed at step n1, thereby making the instrument ready to operate. Thereafter the switch group 2 is scanned, and an operation corresponding to ON/OFF of the function switches including the tone color switch is performed (n2), then, the keyboard 1 is scanned to execute an operation corresponding to ON/OFF of key (n3). If the function switch is turned on or off, data corresponding to this ON/OFF is stored in a pertinent register of the RAM 18. If the tone color selection switch is operated, pertinent tone color data is read from the ROM 17 and is stored in a pertinent register.

FIG. 8 (B) shows key ON event processing. If there is key ON event, this operation is executed. At first, at step n10 the key number of the turned on key is read. Then, the initial touch intensity is detected (n11). Next, a judgement as to whether any other channel is in key on mode (it indicates the key-on except a new key-on), is performed. In the case that any other channel is in key on mode, the process proceeds to n16, else to n13. At the step n13, the envelope parameters (EG parameters) are decided based on the initial touch intensity by using the table shown in FIG. 7, and are sent to the mixing circuit 21. And then the EGON signal is set on (n14). Moreover the reverberation parameters are decided based on the initial touch intensity by using the table shown in FIG. 7 and are sent to the reverberation unit 20. In the above process, when the new key-on event is occurred, all parameters are decided.

Next, a blank channel is retrieved, and a processing to assign a channel so that the turned-on key musical tone is generated is performed (n16), and then the data for this assignment is sent to the tone generator 15 together with other musical tone control parameters (n17). The tone generator 15 which receives this data makes the pertinent channel to generate this musical tone.

FIG. 8 (C) shows the key-off event processing. If key-off event is found, this operation is executed. At first, the key number of turned-off key is read (n20). Next, a judgement as to whether any other channel is in key on mode, is performed. In the case of that any other channel is in key on mode (it indicates the key-off event being not all key-off event.), the process proceeds to step n23, else to step n21. In this process, when all keys are turned off the EGON signal is reset at step n22. Then, the tone silencing data of pertinent key is sent to the tone generator (n23). Thereby the tone generator 15 clears this musical tone.

Figure 9:
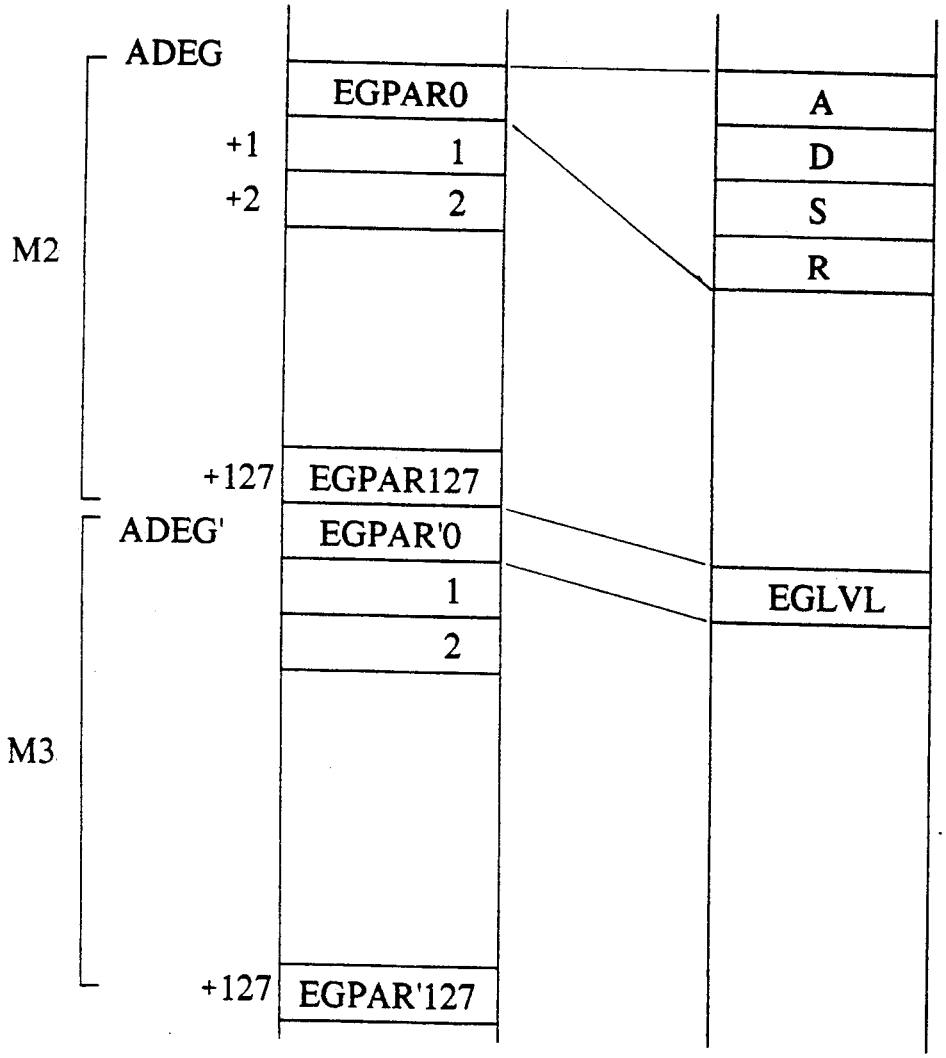
FIG. 9 shows a parameter table of an another embodiment of this invention.

In the embodiment described above, the EGLVL parameter is decided based on the initial touch intensity of the turned on key. In place of such manner, it is possible that the EGLVL parameter is decided based on an after touch intensity of the turned on key. FIG. 9 shows the table to decide the EG parameters in such way. An area M3 is used to decide the EGLVL parameter based on the after touch intensity.

Figure 10:
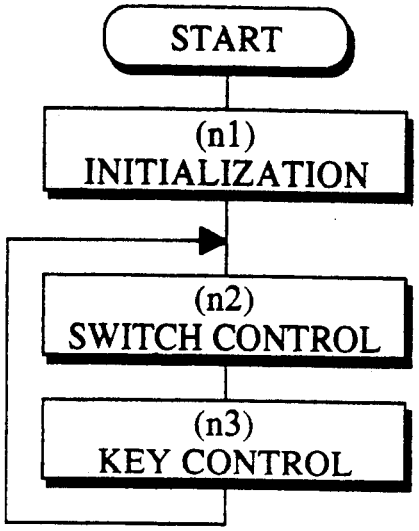
FIGS. 10(A) to 10(C) are flowcharts showing the operations of control section of the another embodiment.
Figure 10:
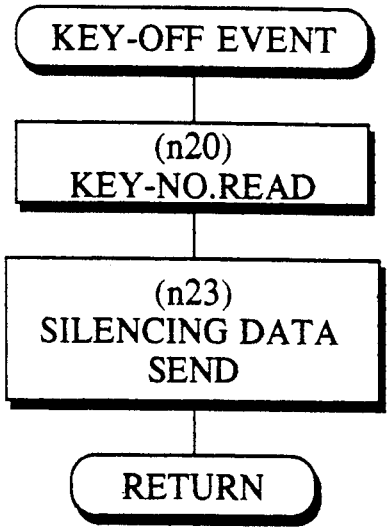
Figure 10:
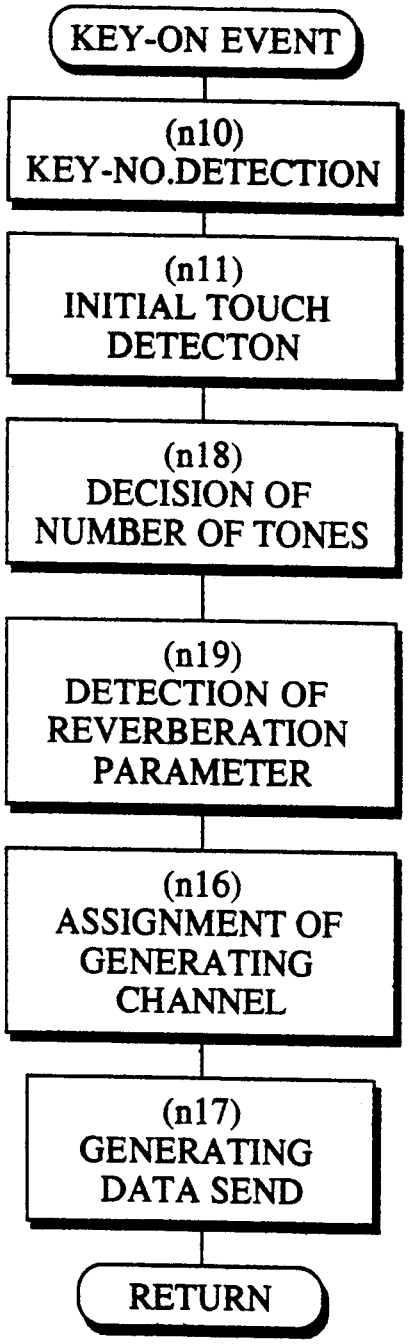

Furthermore, it is possible that the reverberation signal is controlled by the number of tones to be generated. FIGS. 10(A) to 10(C) are flow charts to show this way. FIG. 10(B) differs from FIG. 8(B) at steps n18 and n19. At step n18, the current number of generated tones (the number of tone generating channels) is detected. Then, at step n19, the reverberation parameters are decided based on the detected initial touch intensity and the decided number of tones. In this case, it is possible that the reverberation parameters are decided based on only the decided number of tones. In FIG. 8(C), after the key-NO.is read, the silencing data is sent to the tone generator 15 at once.

In the embodiment described above the mixing circuit 21 is designed so that the musical tone signal (musical tone signal to which reverberation is not given) skipped through the reverberation unit 20 and the musical tone signal (musical tone signal to which reverberation is given) are mixed. It is also possible to output only the reverberation signal from the reverberation unit 20 and then mix the pure musical tone signal (to which reverberation is not given) with its output signal, namely intrinsic reverberation signal. Here, the mixing ratio is decided according to for example, volume level.

In the embodiment described above, the reverberation parameters and the mixing parameters are formed based on the first turned on key. It is possible that their parameters are formed based on the turned on key having the maximum key touch intensity within a predetermined period. Adding to that, it is allowable to proceed the process as being in key on mode during the specific time lag after the key is turned off. In place of such a complex process, the reverberation unit can be polyphonic.

Above is given an explanation of embodiment of this invention, taking an electronic keyboard instrument as an example. The same effects can be obtained by performing the same control on electronic musical instruments which are controlled by other systems such as an electronic wind instrument, and a reverberation effect module controlled by MIDI (Musical Instrument Digital Interface).

I claim:

1. An electronic musical instrument for controlling a reverberation of a musical tone signal comprising:

touch data generating means for generating a touch data representing a characteristic of a key operation;

musical tone signal generating means for generating a musical tone signal based on the touch data;

reverberation signal generating means for generating a reverberation signal corresponding to the musical tone signal;

mixing means for mixing the musical tone signal and the reverberation signal at a mixing ratio; and control means for controlling the mixing ratio based on the touch data.

2. An electronic musical instrument according to claim 1, wherein said reverberation signal generating means comprises reverberation parameter forming means for forming a reverberation parameter based on said touch data, and a reverberation signal forming means for forming said reverberation signal based on the reverberation parameter.

3. An electronic musical instrument according to claim 1, wherein said touch data is an initial touch data representing intensity or velocity of a key operation.

4. An electronic musical instrument according to claim 1, wherein said touch data is an after touch data representing pressure of operation in a key operation.

5. An electronic musical instrument according to claim 1, wherein said reverberation signal generating means comprises:

a plurality of filters, each of which has a specific frequency band pass characteristic; and a plurality of reverberation signal generating circuits to which outputs signal of the filters are inputted respectively;

each filter including control means for controlling an input signal level to the filter on said touch data, whereby a frequency characteristic of said reverberation signal is changed based on said touch data.

6. An electronic musical instrument according to claim 1, wherein, said reverberation signal generating means includes a filter means for changing a frequency of characteristic of said reverberation signal based on said touch data.

7. An electronic musical instrument according to claim 2, wherein said reverberation signal forming means comprises;

delay means for delaying said musical tone signal for a period; and multiplying means for multiplying the delayed signal and a coefficient, wherein said reverberation parameter decides said period and/or said coefficient.

8. An electronic musical instrument according to claim 2, wherein said reverberation signal forming means includes filter means comprising;

delaying means for delaying said musical tone signal for a period; and multiplier means for multiplying the delayed signal and a coefficient, wherein said reverberation parameter decides said period and/or said coefficient.

9. An electronic musical instrument according to claim 7, wherein said reverberation signal forming means further comprises filter means including;

delaying means for delaying said musical tone signal for a second period; and multiplier means for multiplying the signal delayed by said delaying means and a second coefficient, wherein said reverberation parameter decides said second period and/or said second coefficient.

10. An electronic musical instrument for controlling reverberation of a musical tone signal comprising:

touch data generating means for generating a touch data representing a characteristic in an intensity of a key operation;

musical tone signal generating means for generating an musical tone signal based on the touch data;

reverberation signal generating means for generating a reverberation signal corresponding to the musical tone signal based on the touch data;

envelope generating means for generating an envelope based on the touch data; and control means for controlling volume variation of the reverberation signal according to the envelope.

11. An electronic musical instrument according to claim 10, wherein said envelope generating means includes an envelope parameter forming means for forming an envelope parameter based on the touch data, and an envelope generator for generating the envelope based on the envelope parameter.

12. An electronic musical instrument according to claim 11, wherein said touch data generating means comprises a plurality of keys, each of which is ether in a key-on state that the key is depressed or a key-off states that the key is released, said envelope generator rises up when a key is in a key-on state and other keys are in a key-off state and decays when all of said keys are in a key-off state.

13. An electronic musical instrument for controlling a reverberation of a musical tone signal comprising:

musical tone signal generating means having a plurality of musical tone signal generation channels;

touch data generating means for generating touch data representing a characteristic of a key operation;

detecting means for detecting a number of the musical tone signal generation channels which are respectively generating the musical tone signals; and reverberation signal generating means coupled to the musical tone signal generating means, for generating at least one reverberation signal corresponding to the musical tone signals and controlling a characteristic of the reverberation signal based on the touch data and the detected number of channels.

14. An electronic musical instrument according to claim 13, further comprising a plurality of keys, each of which is either in a key-on state that the key is depressed or a key-off state that the key is released, wherein one of the musical tone generation channels generates a musical toner signal when a key of said keys is in a key-on state.

15. An electronic musical instrument according to claim 13, wherein said reverberation signal generating means comprises reverberation parameter forming means for forming a reverberation parameter based on said detected result, and a reverberation signal forming means for forming said reverberation signal based on the reverberation parameter.

16. An electronic musical instrument according to claim 15, wherein said reverberation signal forming means comprises;

delay means for delaying said musical tone signal for a period; and multiplying means for multiplying the delayed signal and a coefficient, wherein said reverberation parameter decides said period and/or said coefficient.

17. An electronic musical instrument for controlling a reverberation of a musical tone signal comprising:

touch data generating means for generating a touch data representing a characteristic of key operation;

musical tone signal generating means for generating a musical tone signal based on the touch data;

reverberation signal generating means for generating a reverberation signal corresponding to the musical tone signal; and control means for controlling a characteristic of the reverberation signal generated by the reverberation signal generating means based on the touch data.

18. An electronic musical instrument for controlling a reverberation of a musical tone according to claim 17, wherein the characteristic of the reverberation signal comprises a reverberation time representing a period for which the reverberation signal is generated.

19. An electronic musical instrument for controlling a reverberation of a musical tone according to claim 17, wherein the characteristic of the reverberation signal comprises a reverberation volume at which the reverberation signal is generated.

* * * * *